US006517466B2

(12) United States Patent
Eyman, Jr. et al.

(10) Patent No.: US 6,517,466 B2
(45) Date of Patent: Feb. 11, 2003

(54) BALANCE BEAM

(75) Inventors: Waldorf Clauson Eyman, Jr., Whitney, TX (US); Bartlett Keith Wyman, Durham, NH (US)

(73) Assignee: Gym-Trix, Inc., Durham, NH (US)

( * ) Notice: Subject to any disclaimer, the term of this patent is extended or adjusted under 35 U.S.C. 154(b) by 0 days.

(21) Appl. No.: 09/862,717

(22) Filed: May 22, 2001

(65) Prior Publication Data

US 2002/0177508 A1 Nov. 28, 2002

(51) Int. Cl.[7] ..... A63B 4/00; A63B 7/08
(52) U.S. Cl. ..... 482/34; 482/23; 482/25
(58) Field of Search ..... 482/23–28, 34

(56) References Cited

U.S. PATENT DOCUMENTS 455,819 A * 7/1891 Medart ..... 482/34
1,041,701 A * 10/1912 Thornley ..... 482/34
1,094,823 A * 4/1914 Thornley ..... 482/34
3,582,068 A * 6/1971 Hallgren et al. ..... 482/34
3,616,126 A * 10/1971 Tungseth ..... 482/34
3,982,738 A * 9/1976 Meier et al. ..... 267/121
3,990,697 A * 11/1976 Reuther ..... 272/111
4,494,662 A * 1/1985 Clymer ..... 272/134
5,037,086 A * 8/1991 Strand ..... 482/34
5,180,349 A * 1/1993 Marcus ..... 482/34
5,421,800 A * 6/1995 Mullen ..... 482/121
5,827,107 A * 10/1998 Bears et al. ..... 446/263
6,077,195 A * 6/2000 Lane et al. ..... 482/38
6,168,549 B1 * 1/2001 Squibb et al. ..... 482/34
6,193,582 B1 * 2/2001 Gleim ..... 446/466
6,322,484 B1 * 11/2001 Muller ..... 482/140

* cited by examiner

*Primary Examiner*—Jerome W. Donnelly
*Assistant Examiner*—Lori Baker Amerson
(74) *Attorney, Agent, or Firm*—Davis & Bujold, P.L.L.C.

(57) ABSTRACT

A balance beam having a shock absorbing capability. The balance beam comprises an elongate beam member, an elongate beam support core supporting the elongate beam member, and a resilient element located between the beam member and the beam support core. The resilient element allows the beam member to move relative to the beam support core when a vertically downward force is exerted on the beam member to absorb shock imparted to the balance beam by a user.

20 Claims, 7 Drawing Sheets

BALANCE BEAM

FIELD OF THE INVENTION

The present invention relates to an improved balance beam for use by gymnasts.

BACKGROUND OF THE INVENTION

While a variety of different balance beams are currently available in the marketplace, they suffer from the drawback of not providing sufficient shock absorbing capabilities when a gymnast jumps or otherwise performs a feat on the balance beam, which requires the gymnast to momentarily leave the balance beam, and then return to the balance beam. As a result of the failure to provide a sufficient shock absorbing capability, gymnasts are occasionally injured during the performance of the feat.

SUMMARY OF THE INVENTION

Wherefore, it is an object of the present invention to overcome the above noted drawbacks of the prior art balance beams.

Another object of the present invention is to provide a balance beam which provides a sufficient shock absorbing capability when a gymnast performs a feat on the balance beam to lessen the impact when the gymnast returns to the balance beam, following performance of the feat, and thereby minimize the likelihood of any injury occurring from such impact.

A further object of the present invention is to provide a shock absorbing capability along the entire length of the balance beam so that each individual section along the length of the balance beam has a similar shock absorbing capability.

Yet another object of the present invention is to allow a top surface of the balance member beam to move vertically with respect to a beam support core while preventing the top surface of the balance beam from becoming skewed or otherwise disoriented with respect to the beam support core.

A still further object of the present invention is to provide a flexible skin surrounding the exterior surface of the improved balance beam to ensure a finger or some other body part does not become lodged between the two relative moving components of the balance beam and thereby minimize the likelihood of any injury occurring to the gymnast or a bystander.

The present invention also relates to a balance beam having a shock absorbing capability, the balance beam comprising: an elongate beam member; an elongate beam support core supporting the elongate beam member; a resilient element located between the beam member and the beam support core, and the resilient element being at least partially compressed to allow the beam member to move relative to the beam support core when a vertically downward force is exerted on the beam member to absorb shock imparted to the balance beam by a user.

The present invention also relates to a method of absorbing shock in a balance beam, the method comprising the steps of: providing an elongate beam member; supporting the elongate beam member via an elongate beam support core; locating a resilient element between the beam member and the beam support core; and at least partially compressing the resilient element, when a vertically downward force is exerted on the beam member, to allow the beam member to move relative to the beam support core and absorb shock imparted to the balance beam by a user.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
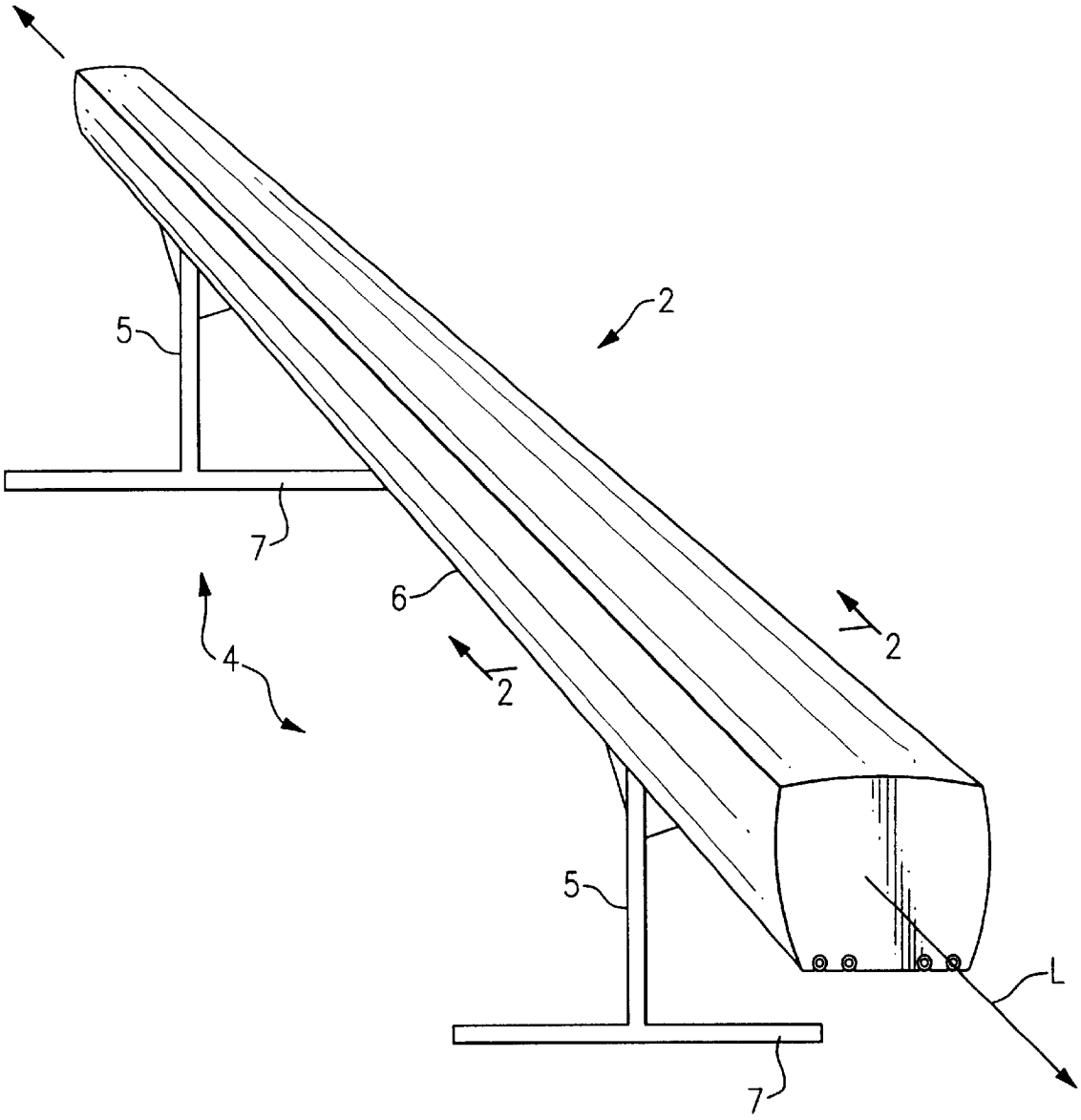
FIG. 1 is a perspective view of the improved balance beam according to the present invention.

Referring now to FIG. 1, the basic components of the improved balance beam according to the present invention will now be discussed. As can be seen in this Figure, the present invention generally comprises an elongate balance beam 2 which is supported by a pair of conventional balance beam supports 4. Each one of the balance beam supports 4 generally comprises a vertically extending support member 5 having a top end secured to a bottom surface 6 of the balance beam 2 and a horizontally extending support member 7 which is secured to a bottom end of the vertically extending support member 5 and engages a floor or some other support surface. As can be seen in this Figure, each one of the balance beam supports 4 also has at least one lateral support (not numbered) interconnecting an intermediate portion of the vertically extending support member 5 with a bottom surface 6 of the balance beam 2 to provide lateral stability for the balance beam support 4. As the lateral, horizontal and vertical balance beam support members are all conventional and well known in the art, a further detailed description concerning the same is not provided.

Figure 2:
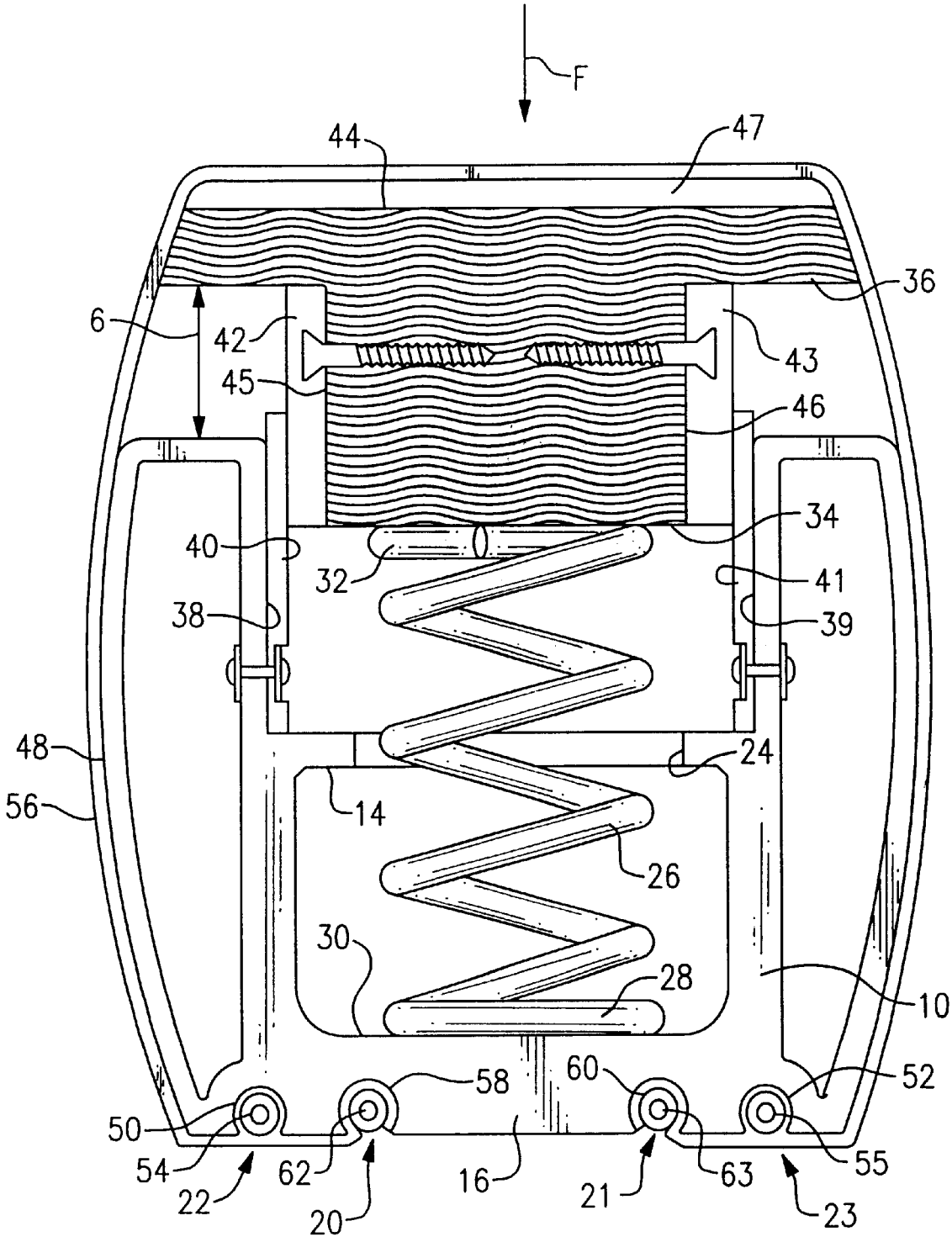
FIG. 2 is a cross-sectional view of the improved balance beam of FIG. 1 along section line 2—2.
Figure 3:
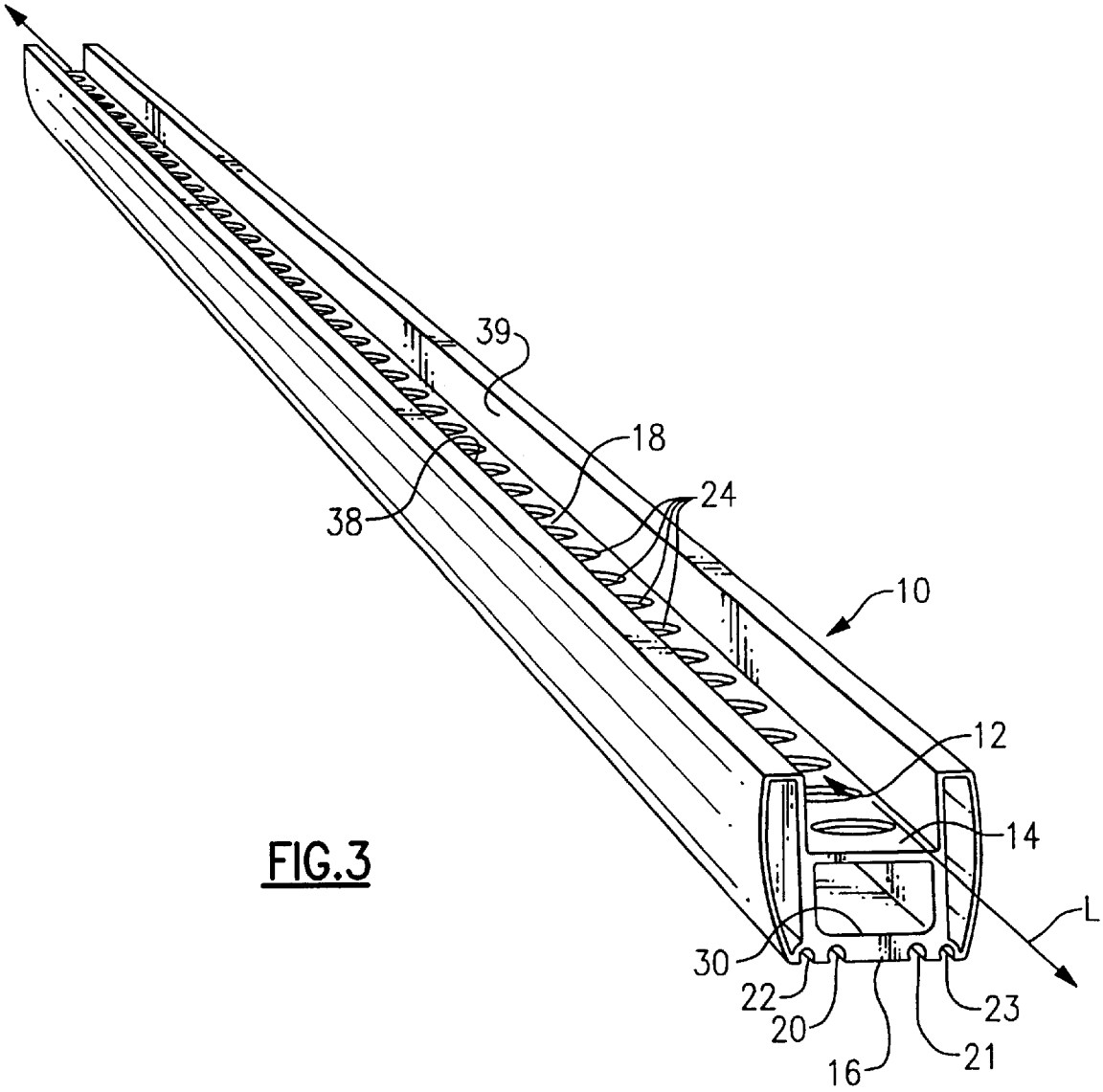
FIG. 3 is a diagrammatic perspective view of the beam support core of FIG. 1.
Figure 4:
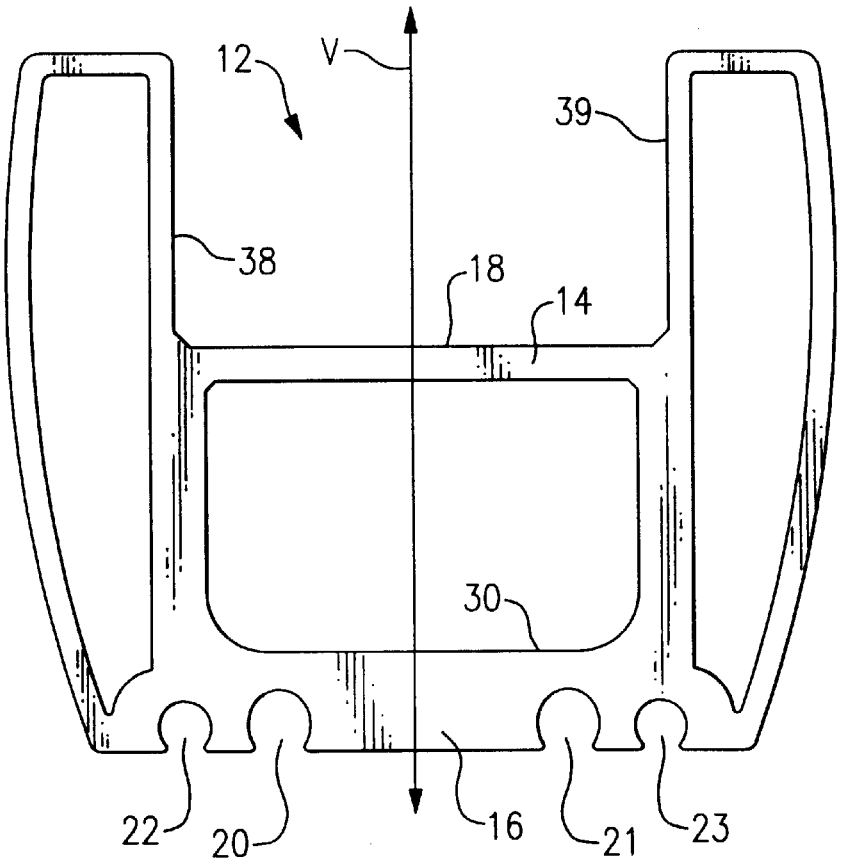
FIG. 4 is an end elevation view of the beam support core of FIG. 3.

With reference now to FIGS. 2 to 4 of the drawings, a detailed description concerning the improvements of the balance beam 2, according to the present invention, will now be provided. As can be seen in FIGS. 3 and 4, the beam support core 10 generally comprises an elongate trough 12 extending the entire axial length of the beam support core 10. The beam support core 10 generally has an H-shaped transverse cross-section (FIG. 4) having an intermediate cross member 14. In addition, a lower portion of the beam support core 10 includes a base cross member 16. An outwardly and preferably downwardly facing bottom surface 6 of the base cross member 16 has a pair of spaced apart elongate outer cover retaining channels 22, 23 which extend along the entire axial length of the beam support core 10. Located between the outer cover retaining channel 22, 23 is a pair of inner cover retaining channels 20, 21 which also extend along the entire axial length of the bottom surface 6 of the beam support core 10. The purpose and function of the retaining channels 20, 21, 22, 23 will be discussed below in further detail.

As shown in FIG. 3, the intermediate cross member 14 is provided with a plurality of apertures 24 equally spaced along the upwardly facing elongate surface 18 of the intermediate cross member 14. Each one of the plurality of apertures 24 accommodates a resilient element 26 (FIG. 2), and each resilient element 26 is preferably a coil spring. Each one of the resilient elements 26 has a first end 28 which abuts against an upwardly facing surface 30 of the base cross member 16, while an opposed end 32 of each resilient element 26 abuts against a downward facing surface 34 of a longitudinal T-shaped beam 36. The resilient elements 26 maintain the T-shaped beam 36 in a desired space relationship with respect to the beam support core 10, e.g. provide a separation space or gap G of about ½ of an inch to about 1 ½ inches, preferably about ⅞ of an inch, but allow relative vertical movement between those two components during performance of a feat by a gymnast on the balance beam 2.

A pair of inwardly facing side surfaces 38, 39 of the elongate trough 12 carry a first set of glide pads 40 or 41, and the first set of glide pads 40, 41 extend substantially along the entire axial length L of the elongate trough 12. The first set of glide pads 40,41 are either glued, bolted, riveted or otherwise conventionally attached to the inwardly facing surfaces 38, 39 of the elongate trough 12. As can be seen in FIG. 2 for example, the first set of glide pads 40, 41 are riveted to the inwardly facing surfaces 38, 39 of the elongate trough 12 so that the pads are maintained in a substantially vertical orientation.

The T-shaped beam 36 carries a mating second set of glide pads 42, 43 which are located along outwardly facing surfaces 45 and 46 of the base portion B of the T-shaped beam. The second set of glide pads 42, 43 are similarly screwed, bolted, riveted or otherwise attached to the base portion B of the T-shaped beam 36. The base portion of the T-shaped beam 36, carrying the second set of glide pads 42, 43, is received by and slidably accommodated within the elongate trough 12, between the first set of glide pads 40, 41, e.g. there is a slight clearance of about 0.0 to about 0.005 thousandths of an inch or so. The width of the base B portion of the T-shaped beam 36 is selected such that the first and second sets of glide pads 40, 42 and 41, 43, respectively, slidably engage with one another to allow substantially only vertical movement of the T-shaped beam 36 along vertical plane V with respect to the beam support core 10.

When a vertically downward directed force F is applied to the T-shaped beam 36, the T-shaped beam 36 moves vertically downward as a result of the resilient elements 26 deflecting under load, e.g. the T-shaped beam 36 moves vertically downwardly between ½ of an inch to about 1½ inches, preferably about ⅞ of an inch or so, and the first and second sets of glide pads 40, 42 and 41, 43, respectively, slidably engage with one another and thereby substantially prevent any skewing, tilting, and/or buckling motion of the T-shaped beam 36 with respect to the beam support core 10.

A top planar surface 44 of the T-shaped beam 36 supports a foam pad 47 which extends substantially along the entire axial length of the T-shaped beam. The foam pad 47 preferably has a thickness of between 0.125 and 0.25 inches or so, but the thickness may vary depending upon the particular application. The hardness of foam pad 47 preferably varies between a durometer of 40 and 110, preferably a durometer of about 70, but the hardness may vary depending upon the particular application. The foam pad 47 preferably comprises a PVC foam material. It is to be appreciated that a variety of other conventional foam (such as open or closed cell) or resilient padding materials could be utilized as the pad. The foam pad 47 is applied to the top surface to minimize wear of the surface cover of the balance beam, while also providing some degree of shock force dissipation. In some applications, the foam pad 47 may be eliminated, depending on the balance beam surface hardness sought.

To minimize the possibility of a finger or other body part of a gymnast, coach, bystander, etc. becoming lodged in a gap G formed between the movable T-shaped beam 36 and the main support core 10, a woven polyethylene inner retaining cover 48 covers the exposed exterior surface of the beam support core 10, the T-shaped beam 36, and the foam pad 47. A first elongate end 50 of the inner cover 48 is received within the elongate outer cover retaining channel 22, the inner cover 48 is stretched about the perimeter of the balance beam 2 and a second elongate end 52 of the outer cover 48 is received by and secured to the second outer cover retaining channel 23. An elongate pin member 54 or 55 is then placed within each of the outer cover retaining channels 22, 23 to maintain inner cover 48 in engagement with the outer cover retaining channels 22 or 23.

An outer cover 56, preferably manufactured from a PVC suede having an elastomer woven scrim, preferably of nylon material, is applied over the elongate inner cover 48 in a similar manner. That is, a first elongate end 58 of outer cover 56 is received within one of the inner cover retaining channels 20 and the outer cover 56 is stretched over the perimeter of the inner cover 48 and a second elongate end 60 of outer cover 56 is received by and secured to the second inner cover retaining channel 21. An retaining channels 20 or 21 to maintain outer cover 56 in engagement within the inner cover retaining channels 20 or 21. It is to be appreciated that a variety of other conventional materials may be utilized as the inner and outer covers 48, 56 as well as a variety of other conventional fastening mechanisms for fastening such materials to the balance beam 2.

Due to the relative movement between T-shaped beam 36 and the beam support core 10, as a gymnast jumps on or lands on the improved balance beam 2, according to the present invention, the T-shaped beam 36 is able to move vertically downward toward the support core 10, along plane V, as the resilient elements 26 compress due to the jumping or the landing force F, also characterized as shock forces, being exerted downwardly on the T-shaped beam member 36. As soon as the downward force F ceases, the resilient elements 26 automatically return the T-shaped member 36, in the direction opposite to the exerted force F, to its original, non-deflected position. The inner and outer covers 48, 56 place a slight vertical tension or load on beam 36 and also prevent over-expansion of the resilient elements 26. Preferably, the resilient elements 26 are slightly compressed by the inner and outer covers 48, 56 and the weight of T-shaped beam 36 in the normal, non-deflected orientation of the balance beam 2.

If desired, the resilient elements 26 may be supported or fixed in a desired position along base cross member 16 by a groove within the base cross member (not shown) or by a raised section(s) spaced along base cross member 16. Similarly, the resilient elements 26 may be supported or fixed in a desired position along the lower surface 34 of the beam by a groove formed in the beam (not shown) or by a raised section(s) spaced along base of the beam. Ends 28 and 32 of the resilient elements 26 may also be fixedly attached to the inwardly facing surface 30 or the downwardly facing surface 34 of the beam by an adhesive or some similar component to fix lateral spacing of the resilient elements 26. The preferred method of fixing the lateral locations of resilient elements 26 is by retention within apertures 24 and application of a slight vertical compressive force on the resilient elements 26 so as to achieve a normally, sightly deflected position as noted above, caused by the weight of the T-shaped beam 36 and tension exerted by the inner and outer covers 48,56.

Figure 5:
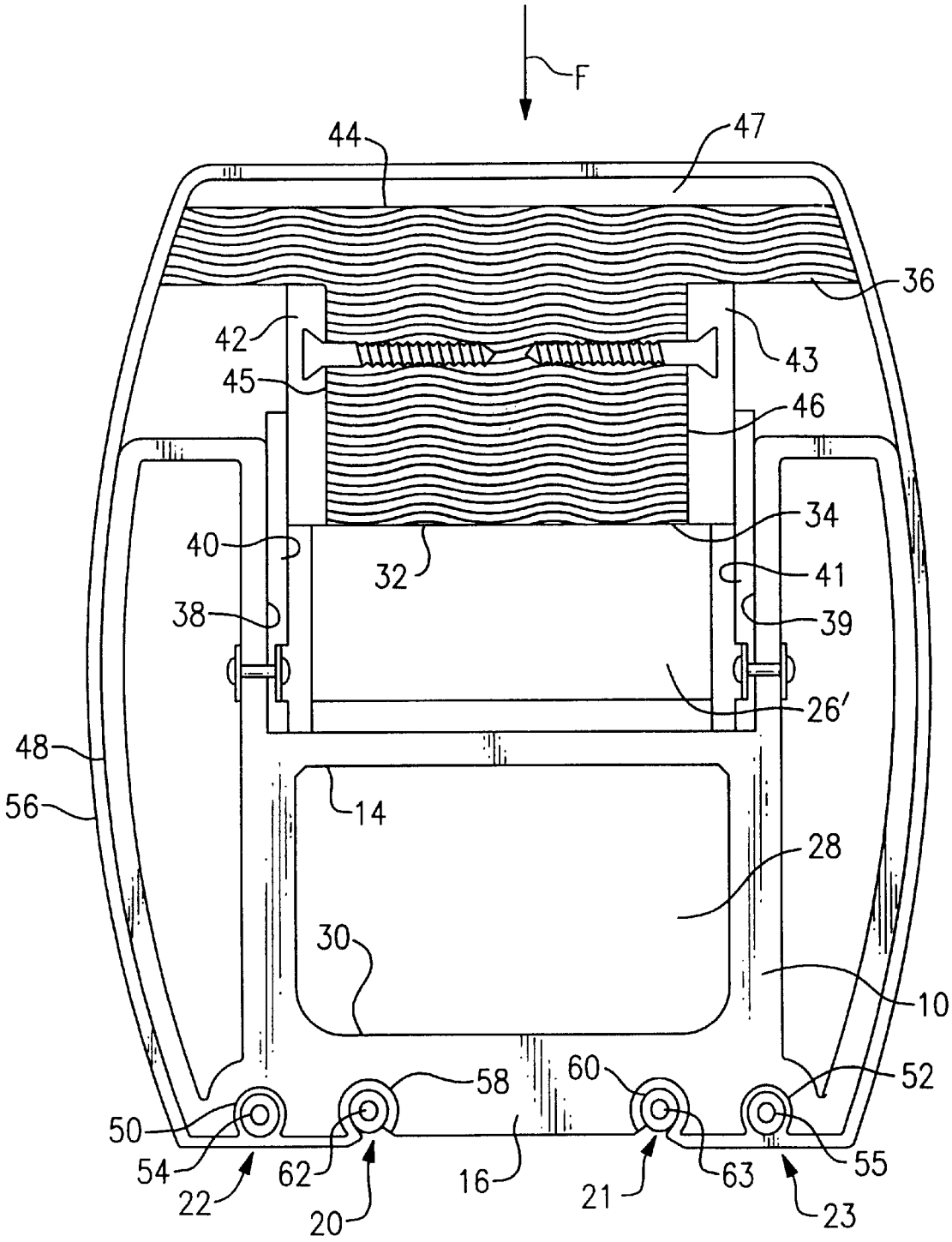
FIG. 5 is a diagrammatic cross-sectional view of a second embodiment of the improved balance beam according to the present invention.

With reference now to FIG. 5, a second embodiment of the improved balance beam 2, according to the present invention, will now be briefly provided. Only differences between this embodiment and the first embodiment is that the coil springs 26 are eliminated in favor of a plurality of leaf springs 26' (only one of which is diagrammatically shown in the drawings) spaced end to end along the length of the balance beam 2. The plurality of leaf springs 26' are equally spaced along and supported by the upwardly facing elongate surface 18 of the intermediate cross member 14. In all other respects, the balance beam of the second embodiment is identical to the balance beam of the first embodiment.

Figure 6:
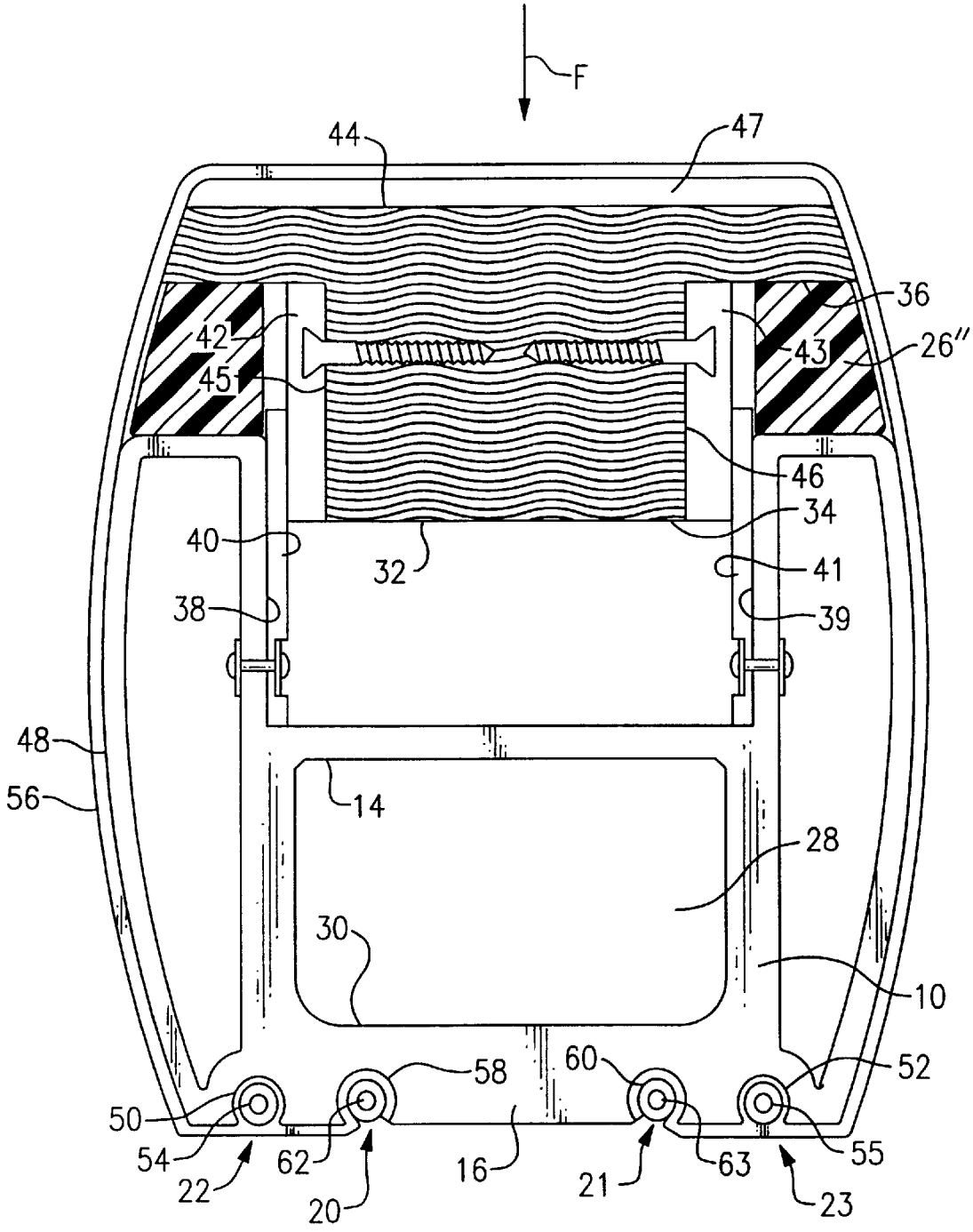
FIG. 6 is a diagrammatic cross-sectional view of a third embodiment of the improved balance beam according to the present invention.

With reference now to FIG. 6, a third embodiment of the improved balance beam 2, according to the present invention, will now be briefly provided. Only difference between this embodiment and the first embodiment is that the coil springs 26 are eliminated in favor of a pair of elongate strips 26" of resilient material, and each one of the two elongate strips of resilient material 26" extends parallel to one another along opposed side edges of the base of the balance beam member. Each one of the two elongate strips of resilient material 26" is located between a downwardly facing surface of the beam member 36 and an upwardly facing surface of the beam support core 10. In all other respects, the balance beam of the second embodiment is identical to the balance beam of the first embodiment.

Figure 7:
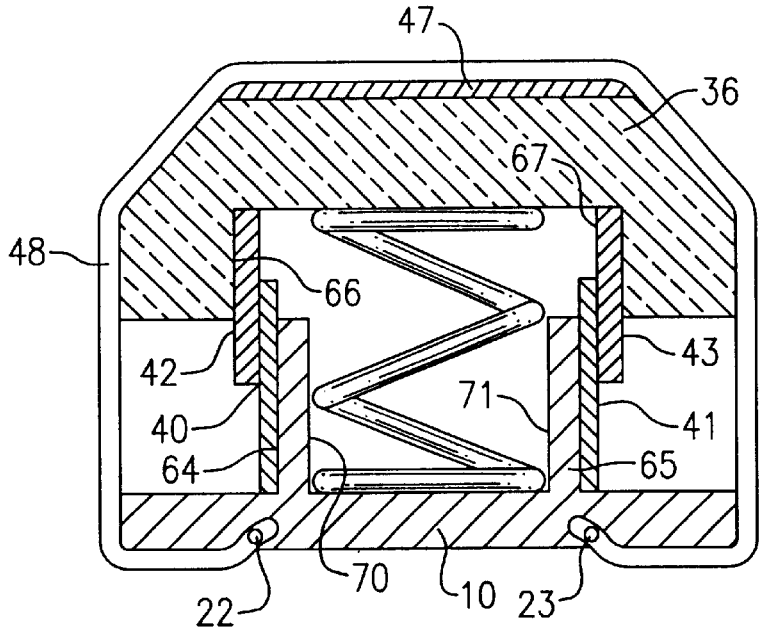
FIG. 7 is a diagrammatic cross-sectional view of a fourth embodiment of the improved balance beam according to the present invention.

With reference now to FIG. 7, a fourth embodiment of the improved balance beam 2, according to the present invention, will now be briefly provided. The major differences between the fourth embodiment and the first embodiment are that the shapes of the balance beam member 36 (e.g. C-shaped) and the beam support core 10 (e.g. planar with a pair of upwardly extending spaced apart legs 70, 71) are modified significantly. Due to modification of the balance beam member 36 and the beam support core 10, the first set of glide pads 40, 41 are supported by outwardly facing surfaces 64, 65 of the upwardly extending legs 70, 71 of the beam support core 10 while the second set of glide pads 42, 43 are supported by the inwardly facing surfaces 66, 67 of the balance beam member 36. In addition, only a single retaining cover 48 covers the exposed exterior surface of the beam support core 10, the beam member 36, and the foam pad 47. As only a single retaining cover is employed, only the outer cover retaining channels 22, 23 are required to secure the retaining cover 48 to the balance beam 2-the inner cover retaining channels 22 are eliminated. In all other respects, the balance beam of the second embodiment is identical to the balance beam of the first embodiment.

Figure 8:
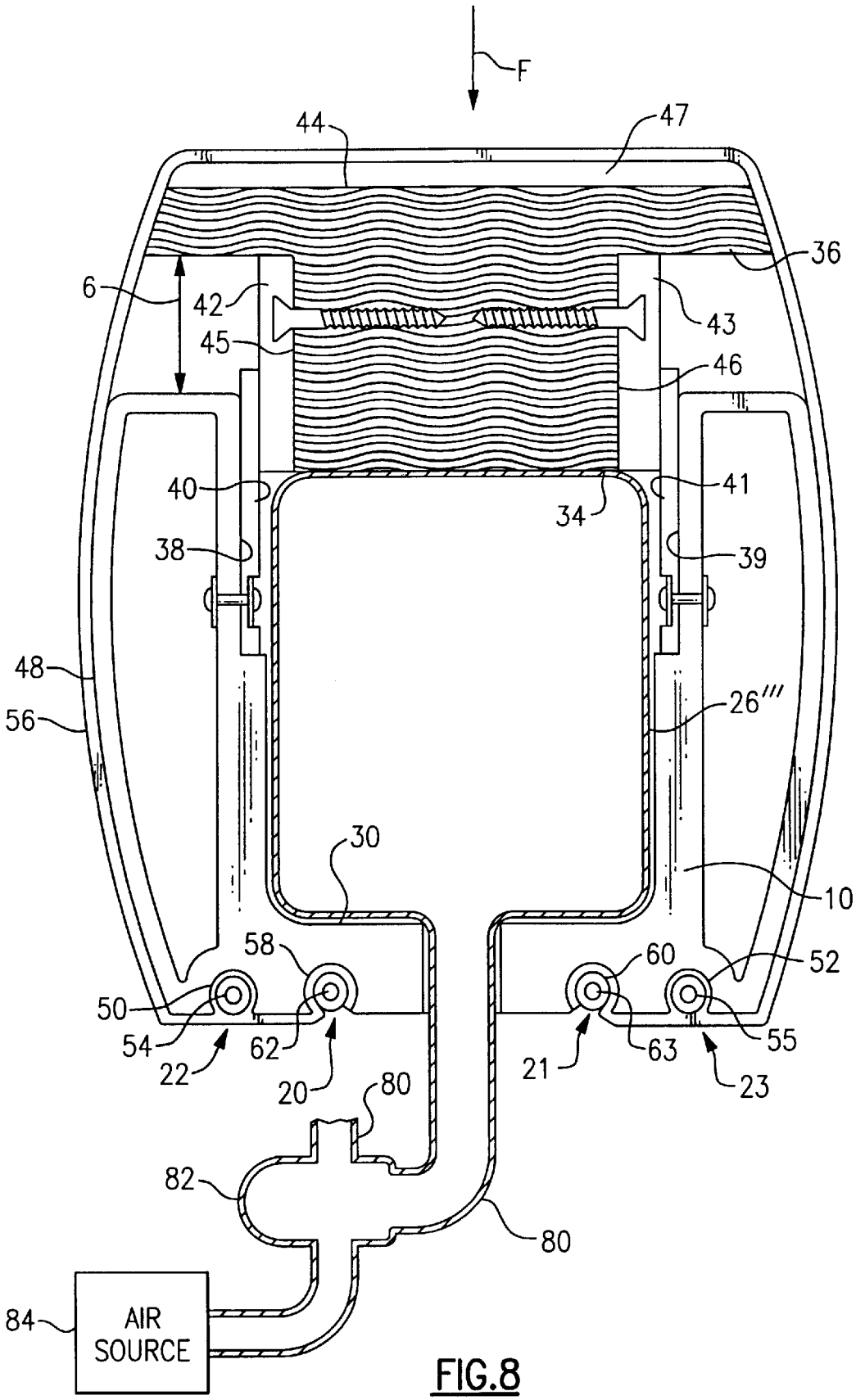
FIG. 8 is a diagrammatic cross-sectional view of a fifth embodiment of the improved balance beam according to the present invention.

With reference now to FIG. 8, a fifth embodiment of the improved balance beam 2, according to the present invention, will now be briefly provided. Only differences between this embodiment and the first embodiment is that the intermediate cross member 14 with the plurality of apertures 24, and the coil springs 26 are all eliminated in favor of a plurality of air springs 26''' (only one of which is diagrammatically shown in the drawings) are accommodated and sequentially spaced along the length of the balance beam 2. Each one of the plurality of air springs 26''' is spaced, preferably in an end to end abutting relationship along the length of the main support core 10 and supported by the upwardly facing elongate surface 30 of the base cross member 16. Each one of the plurality of air springs 26''' has an air supply line 80 coupled to a common manifold 82 so that as air, from an air source 84 (only diagrammatically shown), is supplied to the common manifold 84, the supplied air is equally distributed and each one of the plurality of air springs 26''' is pressurized to a substantially identical pressure by the respective air supply lines 80. By this arrangement, the shocking absorbing capability of the balance beam 2 can be adjusted to provide a greater resistance to compression or vertically downward movement of the movable T-shaped beam 36 relative to the main support core 10, for a heavier user, and lesser resistance to compression or vertically downward movement of the movable T-shaped beam 36 relative to the main support core 10, for a lighter weight user. In all other respects, the balance beam of the fifth embodiment is substantially identical to the balance beam of the first embodiment.

The important aspect of the present invention is the ability of the beam member to move in a substantially vertical direction with respect to the beam support core, while at least one shock absorbing resilient element is provided, between those two components, to permit retardation of the downward movement of the beam member and return the beam member back to its normally unbiased position after beam member moves with respect to the beam support core.

As would be readily apparent to one skilled in the art, a variety of modifications concerning the overall shape and appearance of both the beam member the beam support core as well as the resilient element accommodated therebetween may be employed. Also, a beam member of substantially rectangular cross section (e.g. without a T-shape) could be used, or a beam having a vertical, approximately central longitudinal groove could be supported by a single, vertical, longitudinally running beam support core supporting the resilient means.

The T-shaped beam is preferably manufactured from wood, aluminum or plastic while the support core is preferably extruded aluminum, steel, stainless steel, plastic, etc. The support core may also be fabricated as an assembly of parts in lieu of an extrusion, as economic choices of construction permit.

An important aspect of the present invention is that the top surface of the beam member be flat or planar and, at all times, that top surface lie substantially parallel to a ground surface supporting the balance beam. In addition, it is critical for the planar top surface of the beam member be confined or restricted so as to move only substantially along a vertical plane while constantly and continuously maintaining the planar top surface of the beam member parallel to the ground surface supporting the balance beam, even when the resilient element(s) of the balance beam are compressed while absorbing a force generated by a gymnast preforming by a feat.

Although the above description makes reference to glide pads, it is conceivable that a variety of other mating surfaces or bearing members can be utilized, between the beam member and the beam support core, to allow the vertical movement of the beam member with respect to the beam support core while providing only minimal resistance during such movement. As such other devices, members, surfaces, etc., are conventional and well known in the art, a further detailed discussion concerning those other embodiments is not provided, but it is to be appreciated that such modification(s) will be readily apparent to those skilled in the art.

Since certain changes may be made in the above described improved balance beam, without departing from the spirit and scope of the invention herein involved, it is intended that all of the subject matter of the above description or that shown in the accompanying drawings shall be interpreted merely as examples illustrating the inventive concept herein and shall not be construed as limiting the invention.

We claim:

1. A balance beam having a shock absorbing capability, the balance beam comprising:

an elongate beam member forming a top surface of the balance beam;

an elongate beam support core extending substantially along an entire length of the beam member so that the beam support core supports the beam member substantially along the entire length thereof during use;

at least one resilient element being located between side walls of the balance beam and between the top surface of the beam member and a bottom surface of the beam support core, the at least one resilient element extending substantially along the entire length of the beam member, and the at least one resilient element being at least partially compressible to facilitate movement of the beam member relative to the beam support core when a vertically downward force is exerted on the beam member to absorb shock imparted to the balance beam by a user.

2. The balance beam according to claim 1, wherein at least one beam support supports the beam support core to space the balance beam a desired distance away from a support surface.

3. The balance beam according to claim 2, wherein a pair of spaced apart beam supports are provided for supporting the beam support core and spacing the balance beam a desired distance away from a support surface, and each one of the beam supports comprises a generally horizontal extending support member for engaging with the support surface and a generally vertically extending member for interconnecting the horizontally extending support member with the bottom surface of the beam support core.

4. The balance beam according to claim 3, wherein at least one lateral support member interconnects the generally vertically extending member with the bottom surface of the beam support core.

5. The balance beam according to claim 1, wherein at least one resilient element comprises a plurality of resilient elements sequentially arranged along the entire length of the balance beam, between the beam member and the beam support core, to facilitate movement of the beam member relative to the beam support core when a vertically downward force is exerted on the beam member.

6. The balance beam according to claim 1, wherein the beam member has a generally T-shaped transverse cross section, with a substantially planer top surface, and the substantially planer top surface supports a pad.

7. The balance beam according to claim 6, wherein the pad has a thickness of between 0.125 of an inch and 0.25 of an inch.

8. The balance beam according to claim 1, wherein an exterior outer cover encases a substantial portion of an outer perimeter of the balance beam to facilitate retaining the beam member in engagement with the beam support core and facilitate relative movement between the beam member and the beam support core.

9. The balance beam according to claim 1, wherein an inner cover encases a substantial portion of an outer perimeter of the balance beam and an outer cover encases both the inner cover and the balance beam, and the inner cover and the outer cover both allow relative movement between the beam member and the beam support core.

10. The balance beam according to claim 9, wherein the inner cover is manufactured from a non-woven material and the outer cover is manufactured from a PVC material.

11. The balance beam according to claim 8, wherein the bottom surface of the beam support core has a pair of retaining channels and a first longitudinal edge of the exterior outer cover is received in a first one of the retaining channels and a second opposed longitudinal edge of the exterior outer cover is received within the other outer retaining channel, and a pair of pin members engage with the exterior outer cover and facilitate retention of the exterior outer cover with the retaining channels.

12. The balance beam according to claim 9, wherein the bottom surface of the beam support core has a pair of inner retaining channels and a pair of outer retaining channels;

a first longitudinal edge of the inner cover is received in one of the outer retaining channels and a second opposed longitudinal edge of the inner cover is received in the other outer retaining channel, and a pair of inner cover pin members engage with and facilitate retention of the inner cover within the outer retaining channels; and a first longitudinal edge of the outer cover is received in one of the inner retaining channels and a second opposed longitudinal edge of the outer cover is received in the other inner retaining channel, and a pair of outer cover pin members engage with and facilitate retention of the outer cover within the inner retaining channels.

13. The balance beam according to claim 4, wherein the beam member defines an elongate trough and the elongate trough has a plurality of apertures formed therein and each one of the plurality of apertures supports a resilient element therein to facilitate guided relative movement between the beam member and the beam support core when a vertical downward force is exerted on the beam member.

14. The balance beam according to claim 13, wherein each one of the resilient elements is a coil spring.

15. The balance beam according to claim 1, wherein the beam member defines an elongate trough which has a pair of inwardly facing surfaces which form inwardly facing guides, and the beam support core has a projection which supports a pair of outwardly facing surfaces which form mating guides, and the inwardly facing guides and the outwardly facing guides mate with one another to facilitate vertical movement of the beam member relative to the beam support core when a vertically downward force is exerted on the beam member.

16. The balance beam according to claim 1, wherein the at least one resilient element comprises two elongate strips of resilient material, and each one of the two elongate strips of resilient material extends parallel to one another along opposed side edges of the balance beam, and each of the two elongate strips of resilient material is located between a downwardly facing surface of the beam member and an upwardly facing surface of the beam support core.

17. A balance beam having a shock absorbing capability, the balance beam comprising:

an elongate beam member;

an elongate beam support core supporting the beam member;

at least one resilient element located between the beam member and the beam support core, and the at least one resilient element being at least partially enclosed by the elongate beam support core and being at least partially compressible to facilitate movement of the beam member relative to the beam support core when a vertically downward force is exerted on the beam member to absorb shock imparted to the balance beam by a user; and the beam support core has an elongate trough extending substantially along an entire length of the beam support core, and the at least one resilient element is accommodated within the elongate trough.

18. The balance beam according to claim 17, wherein the elongate trough defines a pair of inwardly facing surfaces which form guides, and a pair of outwardly facing surfaces of the beam member form mating guides which engage with the guides of the inwardly facing surfaces of the trough to facilitate guided vertical sliding movement of the elongate beam member relative to the beam support core.

19. The balance beam according to claim 17, wherein at least one balance beam support supports the beam support core to space the balance beam a desired distance away from a support surface; and at least one surface of the beam member mates with at least one surface of the elongate beam support core to facilitate guided vertical movement of the elongate beam member relative to the elongate beam support core.

20. A method of absorbing shock in a balance beam, the method comprising the steps of:

providing an elongate beam member having a top surface;

extending an elongate beam support core substantially along an entire length of the beam member and supporting the beam member, substantially along the entire length thereof, via the beam support core;

locating at least one resilient element between side walls of balance beam and between the top surface of the beam member and a bottom surface of the beam support core, and the at least one resilient element extending substantially along the entire length of the beam member; and at least partially compressing the at least one resilient element, when a vertically downward force is exerted on the elongate beam member, to allow the beam member to move relative to the beam support core and absorb shock imparted to the balance beam by a user.

* * * * *